US006044602A

United States Patent [19]

Canavan

[11] Patent Number: 6,044,602

[45] Date of Patent: Apr. 4, 2000

[54] LIGHT TRANSMITTING ROOFING STRUCTURE AND METHOD

[76] Inventor: John P. Canavan, 76-403 Shoshone Dr., Indian Wells, Calif. 92210

[21] Appl. No.: 09/118,305

[22] Filed: Jul. 16, 1998

[51] Int. Cl.[7] ..... E04D 3/06

[52] U.S. Cl. ..... 52/306; 52/200; 52/518; 52/478; 52/549

[58] Field of Search ..... 52/200, 518, 543, 52/549, 306, 307, 308, 478

[56] References Cited

U.S. PATENT DOCUMENTS

| | | | |
|---|---|---|---|
| 640,338 | 1/1900 | Turnley . | |
| 964,059 | 7/1910 | Sawyer | 52/518 |
| 1,752,593 | 4/1930 | Giordano | 52/518 |
| 2,093,559 | 9/1937 | Hobbie . | |
| 2,159,665 | 5/1939 | Lytle . | |
| 2,644,410 | 7/1953 | Weber | 52/518 |
| 3,261,132 | 7/1966 | Miller . | |
| 3,282,012 | 11/1966 | Pradal . | |
| 3,332,192 | 7/1967 | Kesssler . | |
| 3,349,534 | 10/1967 | Wotherspoon | 52/518 |
| 3,855,753 | 12/1974 | Terry | 52/518 |
| 3,998,017 | 12/1976 | Whitlock . | |
| 4,145,860 | 3/1979 | Wotherspoon | 52/529 |
| 4,226,070 | 10/1980 | Aragon | 52/57 |
| 4,284,065 | 8/1981 | Brill-Edwards | 126/432 |
| 4,299,201 | 11/1981 | Tsubota | 126/440 |
| 5,303,525 | 4/1994 | Magee . | |
| 5,493,825 | 2/1996 | Gaston . | |
| 5,651,226 | 7/1997 | Archibald | 52/518 |
| 5,675,954 | 10/1997 | Garcia | 52/518 |

*Primary Examiner*—Carl D. Friedman
*Assistant Examiner*—Dennis L. Dorsey
*Attorney, Agent, or Firm*—Eric Karich

[57] ABSTRACT

A light transmitting roofing structure for a building having spaced apart rafters, and a method of use thereof, has a plurality of concave pan tiles mounted on and attached to the rafters, with a plurality of convex roof tiles attached to the rafters and overlapping the pan tiles on either side. The pan tiles are made of a light transmitting material. The roof tiles are similar to traditional roof tiles, giving the roofing structure the external appearance of a traditional roof.

15 Claims, 2 Drawing Sheets

LIGHT TRANSMITTING ROOFING STRUCTURE AND METHOD

BACKGROUND OF THE INVENTION

1. Field of the Invention

This invention relates generally to roofing structures for buildings, and more particularly to roofing structures that transmit light.

2. Description of Related Art

The following art defines the present state of this field:

Gaston, U.S. Pat. No. 5,493,825, discloses a light-transmissive decking section for use n a decking assembly for supporting a user while allowing the user to receive light through the decking assembly. The light transmissive decking section is provided with a light-transmissive top section. The transmissive properties of the light-transmissive decking section increase the aesthetic appeal of the decking assembly and allow the light to be used below the decking assembly for illumination and heat. The light-transmissive decking section may also be provided with a light or solar panel to alternatively emanate light or generate power from ambient light.

Magee, U.S. Pat. No. 5,303,525, discloses a building structure partially covered with siding panels, the outer surface of which are transparent to solar energy, the panels being slightly spaced from an insulating wall of the building to allow a fluid flow, preferably air, therebetween with effective heat exchange from solar radiation absorbing surface with the fluid being selectively utilizable for space heating purposes or other purposes. The air can be moved by fans or convection or both. A preferred embodiment employs small horizontal lenticular lenses in the transparent material on the surface of the siding together with a mask, which may be three dimensional, on the back of the siding with the result that when the siding is viewed from the horizontal it displays a decorative color while it is highly reflective for solar rays at high angles of elevation and is transparent for solar rays at low angles of elevation, as during winter months. A black absorbent metallic foil surface may be provided on the insulating wall for absorbing the unmasked solar radiation, and the siding is structured to direct airflow to enhance heat transfer from the radiation absorbing surface.

Whitlock, U.S. Pat. No. 3,998,017, discloses a building structure which utilizes logs or timbers of readily available dimensions. A plurality of timbers are horizontally disposed in parallel, vertically spaced relationship to form wall sections. Intermediate each pair of adjacent horizontal timbers there is a pair of convex panels of flexible synthetic resinous material, symmetrically disposed about the vertical axis. Upper and lower edges of each panel are inserted into oblique panel-receiving slots provided in the upper and lower surfaces of each horizontal timber. The panels are preferably inserted after assembly of the timbers and support no direct load. Insulating material is placed between each pair of panels. The panels may be inserted during or after assembly of overlapping end surfaces of timbers of end-adjacent vertical walls. If desired, insulating material may be inserted in the confined zone between panels and successive logs. Preferably, substantially light-permeable panel members are used and substantially light-permeable insulting means is used between panel members to permit natural lighting of the interior of the building structure during daylight hours.

Further inventions include Kessler, U.S. Pat. No. 3,332,192, Pradal, U.S. Pat. No. 3,282,012, Miller, U.S. Pat. No. 3,261,132, Hobbie, U.S. Pat. No. 2,093,559, Lytle, U.S. Pat. No. 2,159,665, and Turnley, U.S. Pat. No. 640,338. None of these structures teach a roofing structure with the structure and benefits disclosed in the present invention.

The prior art teaches the use of transparent or translucent roofing materials to allow light through the roof. However, the prior art all suffers from a lack of aesthetics, requiring unsightly modifications to the roofing structure to make the structure transparent. The prior art does not teach a transparent roofing material that looks like a traditional roofing structure.

The present invention fulfills these needs and provides further related advantages as described in the following summary.

SUMMARY OF THE INVENTION

The present invention teaches certain benefits in construction and use which give rise to the objectives described below. The present invention provides a light transmitting roofing structure for a building having spaced apart rafters, and a method of use thereof. The roofing structure includes a plurality of concave pan tiles mounted on and attached to the rafters, with a plurality of convex roof tiles attached to the rafters and overlapping the pan tiles on either side. The pan tiles are made of a light transmitting material. The roof tiles are similar to traditional roof tiles, giving the roofing structure the external appearance of a traditional roof.

A primary objective of the present invention is to provide a light transmitting roofing structure for a building having spaced apart rafters, the roofing structure having advantages not taught by the prior art.

Another objective is to provide a roofing structure that is at least partially translucent or transparent, allowing light through the roofing structure.

A further objective is to provide a roofing structure that resembles a traditional roof, without any of the undesirable aesthetic qualities of prior art light transmitting roofing structures.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention, a light transmitting roofing structure 20 for a building having spaced apart rafters 10. In its preferred embodiment, the roofing structure 20 includes a plurality of concave pan tiles 30 mounted on and attached to the rafters 10, with a plurality of convex roof tiles 40 attached to the rafters 10 and overlapping the pan tiles 30 on either side. The pan tiles 30 are made of a light transmitting material, causing the roofing structure 20 to simulate a skylight. The roof tiles 40 are similar to non-translucent traditional roof tiles. Since the roof tiles 40 are mounted on top of the pan tiles 30, the roof tiles 40 give the roofing structure 20 an overall appearance similar to that of a traditional roof.

Figure 1:
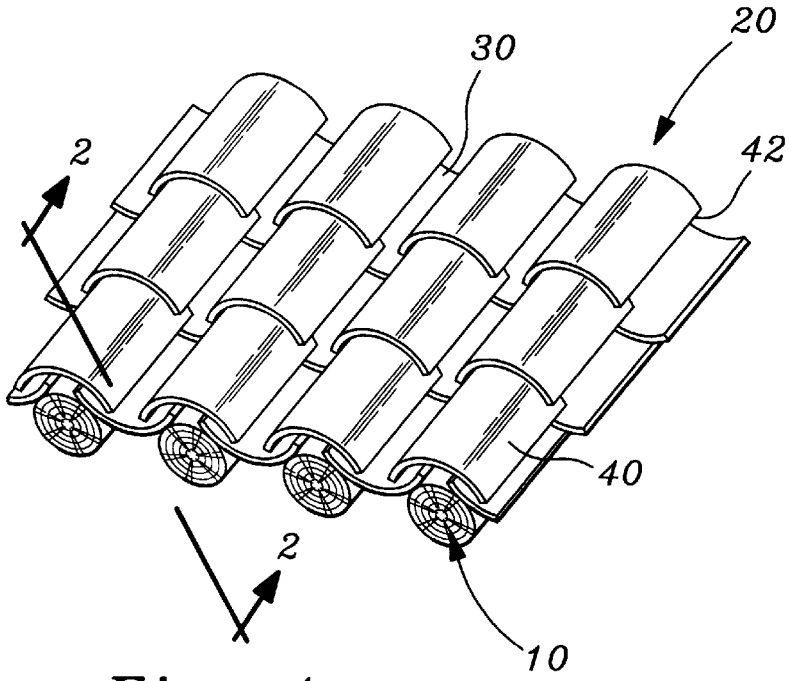
FIG. 1 is a perspective view of the preferred embodiment of the present invention, the invention being installed on a building having lodge pole rafters that are positioned perpendicular to the edge of the roof.
Figure 2:
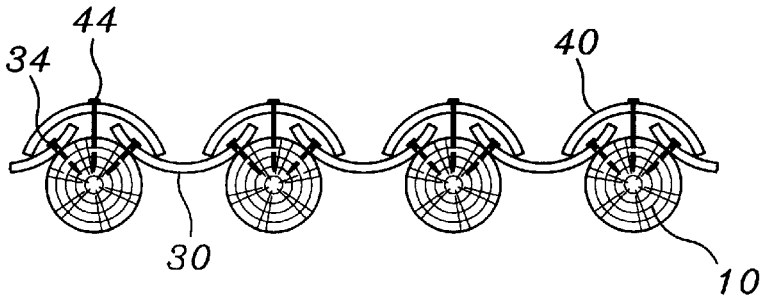
FIG. 2 is a front elevational view thereof taken along line 2—2 in FIG. 1.
Figure 3:
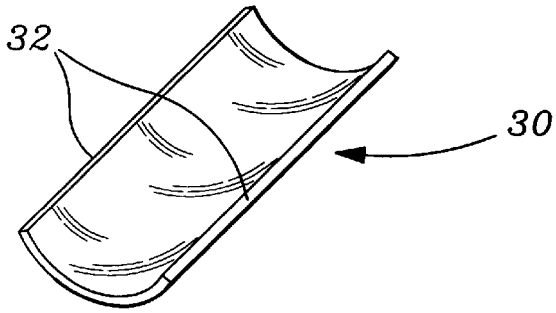
FIG. 3 is a perspective view of a single pan tile.

The specific size and shape of the roofing structure 20 will vary to accommodate the specific construction of the building. A first configuration is shown in FIGS. 1 and 2. In this configuration, the building has spaced apart lodge pole rafters 10 that are positioned perpendicular to the edge of the roof. In the preferred embodiment, as shown in FIG. 3, the pan tiles 30 are generally rectangular in shape with a generally U-shaped cross section. The pan tiles 30 are each wide enough to overlap the pair of adjacent rafters 10 on the building on which they are used. An average pan tile 30 in the preferred embodiment is approximately 16 inches long and 8 inches wide, although these measurements will vary according to the requirements of a specific installation. The pan tiles 30 each have opposite sides 32 across the width of the pan tile 30. As shown in FIG. 2, the pan tiles 30 are positioned between the rafters 10 such that the convex side of each pan tile 30 fits between the pair of adjacent rafters 10 and faces downwards towards the rafters 10. Each side of each of the pan tile 30 is then attached to one of the rafters 10, preferably with a pan nail 34. The pan tiles 30 are arranged in overlapping courses down the length of the roof. If the top edge of the pan tile 30 is somewhat smaller than the bottom edge, the pan tiles 30 are easier to overlap, although this feature is not required. Each of the pan tiles 30 is made of a light transmitting material, preferably a plastic or an acrylic resin. The material must be at least partially translucent, and the material is transparent in acceptable embodiments. The material is colored or tinted in other embodiments, providing a desired character and diffusion to the light entering the building. The material is most preferably the material sold under the trademark LUCITE™. After years of extensive testing, LUCITE™ has proven to be a reliable and durable material that can withstand exposure to the elements and great extremes in temperature without splitting or disintegrating.

The first configuration of the roofing structure 20 further includes a plurality of convex roof tiles 40. The convex roof tiles 40 are preferably traditional clay tiles such as those commonly used in the construction of residential homes and apartments. The roof tiles 40 have opposite edges 42. In its preferred embodiment, the roof tiles 40 are mounted on top of and partially cover the pan tiles 30 such that the edges 42 overlap the sides 32 of the adjacent pan tiles 30. The roof tiles 40 are fastened to the rafters 10, preferably with long nails 44. The roof tiles 40 are preferably made of clay or terra cotta. These convex roof tiles 40 are the only part of the invention that is plainly visible to a casual observer looking at the exterior of the building.

The traditional look of the roof tiles 40 is essential to the invention. The roof tiles 40 provide an aesthetically pleasing exterior that covers the less visually pleasing look of the LUCITE™ pan tiles 30.

Figure 4:
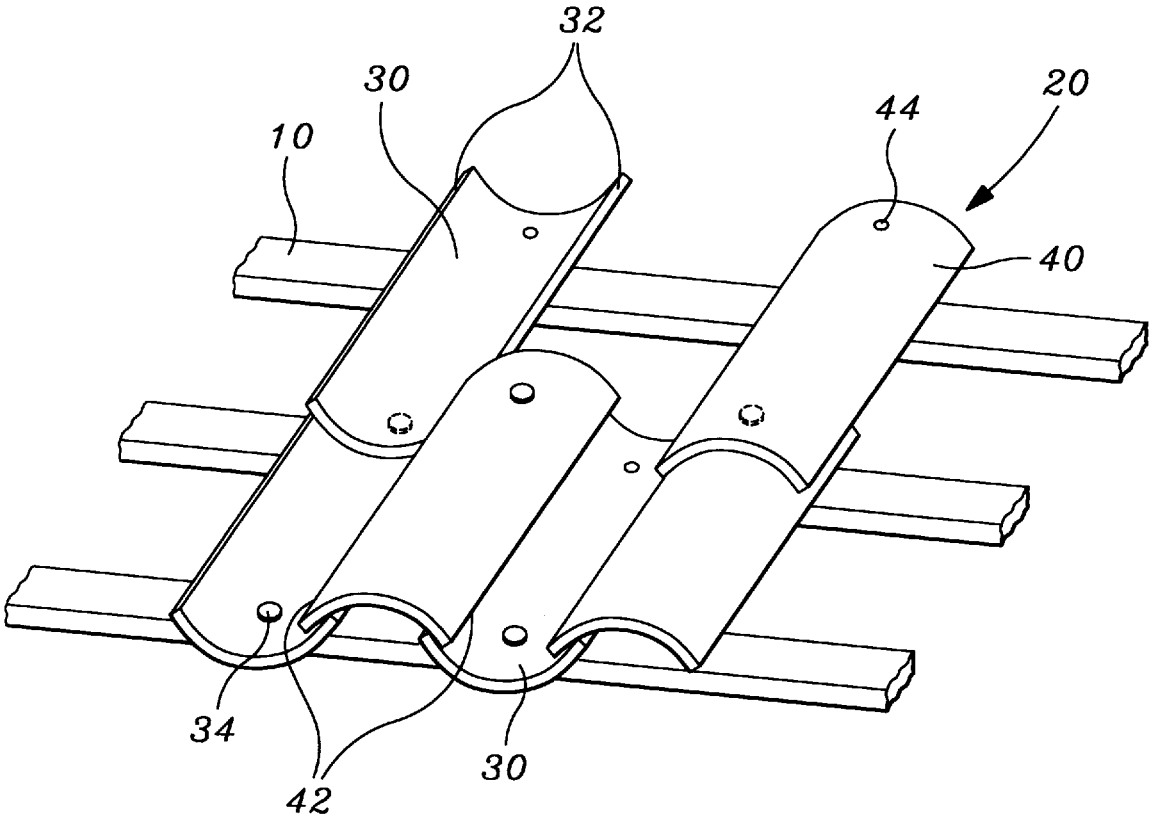
FIG. 4 is a perspective view of an alternative method of installing the roofing structure on a building having rafters positioned parallel to the edge of the roof.

A second configuration, shown in FIG. 4, is useful for buildings having 2×2 rafters 10 positioned parallel to the edge of the roof. In this configuration, the pan tiles 30 and the roof tiles 40 are positioned perpendicular to and across the rafters 10 rather than parallel to and between the rafters 10. The pan tiles 30 are fastened to the rafters 10 with at least one, preferably two, pan nails 34. The roof tiles 40 are fastened to the rafters 10 with long nails 44. The pan tiles 30 and the roof tiles 40 are arranged in overlapping courses down the roof. The pan and roof tiles 40 preferably overlap enough so that the pan nails 34 and the long nails 44 are covered by the next pan tile 30 or roof tile 40, thereby preventing leakage. These construction techniques are well known in the art, and can be modified as required to adapt the invention to any given roof having any given rafter structure.

This invention further includes a method for constructing a light transmitting roofing structure 20 on a building having spaced apart rafters 10. The first step of this method is to provide a roofing structure 20 as described above, including both a plurality of a plurality of concave pan tiles 30 made of a light transmitting material, and a plurality of a plurality of convex roof tiles 40. A plurality of the pan tiles 30 are then fastened to two of the rafters 10 near the eaves of the roof, such that the pan tiles 30 span the space between the pair of rafters 10, with the convex side of each pan tile 30 adjacent to the rafters 10. The pan tile 30 is preferably fastened to the rafters 10 with a pan nail. The pan tiles 30 are preferably fastened to the rafters 10 with nails. Additional pan tiles 30 are then added to the roofing structure 20 in overlapping courses until the entire roof is covered with spaced rows of pan tiles 30 running perpendicular to the edge of the roof. A plurality of the roof tiles 40 are then fastened on top of the pan tiles 30 such that the edges 42 of the roof tiles 40 overlap the sides 32 of the adjacent pan tiles 30. The roof tiles 40 are preferably fastened to the rafters 10 with long nails 44. Most preferably, cement is also added to further strengthen the roof and secure the roof tiles 40 to the roof. Additional roof tiles 40 are added to the roofing structure 20 in overlapping courses until the entire roof is covered with spaced rows of roof tiles 40 running parallel to and overlapping the rows of pan tiles 30. In its most preferred configuration, well known in the art, additional roof tiles 40 are added to the roofing structure 20 near the eaves of the roof, to improve the aesthetics of the roofing structure 20. The novelty of this invention lies in the combination of the [translucent] pan tiles 30 constructed from a translucent material and [traditional clay] the roof tiles 40 constructed from a traditional clay material.

The novelty of this invention lies in the combination of the [translucent] pan tiles 30 constructed from a translucent material and [traditional clay] the roof tiles 40 constructed from a traditional clay material. While the roof tiles 40 must conform to a traditional look in order to provide the aesthetic qualities desired by the consumer, the pan tiles 30 are not constrained to any specific shape except by the convenience of the roofing installer. Using a pan tile 30 having a different shape is equivalent to the current invention if that pan tile 30 is light transmitting and capable of being covered with traditional pan tiles 30. As an example, instead of using individual tiles, the pan tiles 30 could be formed as a large single sheet of light transmitting material. These potential alternative embodiments are equivalent to the claims described herein.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A light transmitting roofing structure comprising:

at pair of spaced apart rafters;

a plurality of pan tiles made of a light transmitting material, each of the pan tiles being fastened to at least one of the pair of spaced apart rafters; and a plurality of convex roof tiles mounted on top of and partially covering the pan tiles, the roof tiles being attached to at least one of the pair of spaced apart rafters, the roof tiles being constructed of non-translucent material to resemble traditional roof tiles.

2. The light transmitting roofing structure of claim 1 wherein the pan tiles are concave and have opposite sides.

3. The light transmitting roofing structure of claim 2 wherein the pan tiles are generally rectangular in shape and are arranged in overlapping courses down the length of the roof.

4. The light transmitting roofing structure of claim 1 wherein the pan tiles are fastened to the rafters with nails.

5. The light transmitting roofing structure of claim 1 wherein the pan tiles are made of plastic.

6. The light transmitting roofing structure of claim 1 wherein the pan tiles are made of an acrylic resin.

7. The light transmitting roofing structure of claim 1 wherein the roof tiles have opposite edges, the roof tiles being positioned such that each of the edges overlap the adjacent pan tiles.

8. The light transmitting roofing structure of claim 1 wherein the roof tiles are made of clay.

9. The light transmitting roofing structure of claim 1 wherein the roof tiles are made of terra cotta.

10. A method for constructing a light transmitting roofing structure on a building having spaced apart rafters, the method comprising the steps of:

a) providing a plurality of a plurality of concave pan tiles made of a light transmitting material, the pan tiles having opposite sides;

b) providing a plurality of a plurality of convex roof tiles, the roof tiles having opposite edges the roof tiles being constructed of non-translucent material to resemble traditional roof tiles;

c) fastening a plurality of pan tiles to the rafters near the eaves of the roof, the pan tiles being positioned is a parallel and spaced apart relationship relative to each other;

d) fastening another plurality of pan tiles above and overlapping the pan tiles already in place, and adding additional pan tiles until the arrangement of overlapping pan tiles reaches the top of the roof;

e) fastening a plurality of roof tiles to the rafters near the eaves of the roof such that the edges of the roof tiles overlap the sides of the adjacent pan tiles; and f) fastening another plurality of roof tiles above and overlapping the pan tiles already in place, and adding additional roof tiles until the arrangement of overlapping pan tiles reaches the top of the roof.

11. The method of claim 10 wherein the roof tiles are made of terra cotta.

12. The method of claim 10 wherein the roof tiles are made of clay.

13. A light transmitting roofing structure for a building having a pair of spaced apart rafters, the roofing structure comprising:

a plurality of pan tiles made of a light transmitting material, each of the pan tiles being shaped to be fastenable to at least one of the rafters such that the pan tile overlaps the pair of spaced apart rafters; and a plurality of convex roof tiles shaped to be mounted on top of and partially covering the plurality of pan tiles when the plurality of pan tiles are fastened to one of the spaced apart rafters, the roof tiles further being shaped to be attached to at least one of the pair of spaced apart rafters and said roof tiles are made of a non-translucent material.

14. The light transmitting roofing structure of claim 13 wherein the roof tiles are made of terra cotta.

15. The light transmitting roofing structure of claim 13 wherein the roof tiles are made of clay.

* * * * *